US010066898B1

(12) United States Patent
Coburn et al.

(10) Patent No.: US 10,066,898 B1
(45) Date of Patent: Sep. 4, 2018

(54) STOCK FOR A FIREARM

(71) Applicant: Savage Arms, Inc., Westfield, MA (US)

(72) Inventors: Ronald Coburn, Spofford, NH (US); Scott Warburton, Ludlow, MA (US)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 15/419,820

(22) Filed: Jan. 30, 2017

Related U.S. Application Data

(63) Continuation of application No. 14/823,938, filed on Aug. 11, 2015, now abandoned, which is a continuation of application No. 11/831,417, filed on Jul. 31, 2007.

(51) Int. Cl.
*F41C 23/16* (2006.01)
*F41A 3/66* (2006.01)

(52) U.S. Cl.
CPC ..... *F41C 23/16* (2013.01); *F41A 3/66* (2013.01)

(58) Field of Classification Search
CPC ..... F41A 21/00; F41A 21/48; F41A 21/485; F41A 21/487; F41C 23/00; F41C 23/06; F41C 23/16; F41C 27/00
USPC ..... 42/97, 71.01, 72, 73, 74, 75.01
See application file for complete search history.

(56) References Cited

U.S. PATENT DOCUMENTS 1,307,469 A 6/1919 Wilson
1,768,372 A 6/1930 Powell
2,140,945 A 12/1938 Swartz
2,205,982 A 6/1940 Klipsch
2,302,699 A 11/1942 Klipsch
2,372,568 A 3/1945 Grigg
2,479,594 A 8/1949 Yasho
2,497,861 A 2/1950 Brown, Jr.
2,585,195 A 2/1952 Walker
2,589,912 A 3/1952 Weld
2,610,426 A 9/1952 Emerson
2,749,641 A 6/1956 Hauck
2,752,714 A 7/1956 Landwehr
2,841,909 A 7/1958 Temple
2,845,737 A 8/1958 Hoyer
2,921,396 A 1/1960 Larson
3,060,612 A 10/1962 Brown et al.
3,206,885 A 9/1965 Dye
3,340,641 A 9/1967 Recker
3,350,807 A 11/1967 Monroe
3,604,136 A 9/1971 Edwards
3,830,003 A 8/1974 Clerke
4,057,924 A 11/1977 Joseph
4,211,146 A 7/1980 Bradley
4,282,671 A 8/1981 Wood et al.
4,385,464 A 5/1983 Casull
4,674,216 A 6/1987 Ruger et al.
5,020,260 A 6/1991 Houghton
5,423,145 A 6/1995 Nasset
5,864,978 A 2/1999 McRary et al.
(Continued)

*Primary Examiner* — Jonathan C Weber
(74) *Attorney, Agent, or Firm* — Christensen, Fonder, Dardi & Herbert PLLC

(57) ABSTRACT

An improved firearm. The improved firearm includes a barreled action; a stock; and a support located between the barreled action and the stock. In one preferred embodiment, the support includes a center support rail and a pair of side rails located parallel to the center support rail. In another preferred embodiment of the inventions, the firearm also includes a harmonic tuner assembly for the barrel.

19 Claims, 6 Drawing Sheets

(56) References Cited

U.S. PATENT DOCUMENTS

| | | | |
|---|---|---|---|
| 6,256,921 | B1 | 7/2001 | Howard et al. |
| 6,301,817 | B1 | 10/2001 | Hogue et al. |
| 6,427,372 | B1 | 8/2002 | Howard et al. |
| 6,487,805 | B1 | 12/2002 | Reynolds |
| 6,637,142 | B1 | 10/2003 | Reynolds |
| 6,889,462 | B1 | 5/2005 | Carlson |

STOCK FOR A FIREARM

RELATED APPLICATION

The present application is a continuation of U.S. patent application Ser. No. 14/823,938, filed Aug. 11, 2015, which is a continuation of U.S. patent application Ser. No. 11/831,417, filed on Jul. 31, 2007, which are incorporated by reference herein in their entireties.

BACKGROUND OF THE INVENTION

(1) Field of the Invention

The present invention relates generally to firearms and, more particularly, to an improved stock for a firearm.

(2) Description of the Prior Art

Firearms are well known and have been used for many years for a variety of purposes including for hunting, weaponry and recreation. Conventional firearms included a barreled portion that was secured to a wooden or synthetic stock through the use of a fastener assembly at the rearward portion of the barrel and action. The previous design left the barrel in a cantilever position whereby the barrel was susceptible to misalignment due to gravitational, heat, manufacturing, weather and operational concerns. In addition to misalignment concerns, a firearm produces a harmonic frequency in the barrel during the course of firing. As the barrel experienced misalignment, the harmonic frequency of the firing action would change causing the firearm to fire differently. Since firearm accuracy is crucial to the efficacy of any firearm, many designs have been made to address this problem.

Prior art designs aimed at remedying these problems generally included a support mechanism embedded in the stock at the forward end of the barrel. This support mechanism thereby provided a support at both ends of the barrel but was deficient because the intermediate sections of the barrel were unsupported and still subject to the same problems that had plagued previous unsupported designs. Still other designs were complex and unattractive to the typical firearm operator. Many designs utilized a series of counterweights located beneath the firearm that were movable along the barrel axis, but these designs were problematic because of increased weight and size concerns. Thus, there remains a need for an improved firearm with substantial support means for maintaining firearm barrel alignment.

SUMMARY OF THE INVENTION

This disclosure is directed towards an improved firearm including a barreled action; a stock; and a support located between the barreled action and the stock. In one preferred embodiment, the support includes (a) a center support rail and (b) a pair 5 of side rails located parallel to the center support rail. In another preferred embodiment, the firearm includes a harmonic tuner assembly for the barrel. The harmonic tuner assembly may be located between the barrel of the barreled action and the center support rail. In some embodiments, the location of the harmonic tuner assembly is moveable along the length of the center support rail adjacent to the barrel of the barreled action, whereby the harmonic energy wave of said harmonic tuner assembly is adjustable. In alternate embodiments, the harmonic tuner assembly includes a tuning fork.

In various embodiments, the stock includes a forestock and a handle, in which the handle further includes a shoulder portion. The stock may be formed of a synthetic material and preferably is injected molded. In some embodiments, the stock is formed from a thermoplastic material, which may include polyester resin and filler material.

In embodiments, the center support rail extends from the receiver of the barreled action to the forestock of the stock and may further include a shoulder portion for receiving the recoil lug of the barreled action. The firearm may also include a wedge mechanism for securing the recoil lug against the shoulder portion of said center support rail and may further include at least one aperture for receiving a fastener for attaching at least one swivel to the center support rail. The center support rail may further include at least one aperture for receiving a fastener for attaching the receiver of the barreled action to the center support rail. In addition, the center support rail may further include a slotted opening in the center support rail for receiving the ammunition feeding system, such as a magazine box of the barreled action.

In various embodiments, the side rails extend substantially the length of the receiver of the barreled action for supporting the body of the receiver. In some embodiments, the distal ends of the side rails are inwardly sloped adjacent to the body of the receiver of the barreled action and the side rails may be flexible. In this embodiment, the side rails and the center support rail are in contact with the body of the receiver of the barreled action thereby controlling vibration transmission from the barrel of the barreled action when the firearm is fired. In some embodiments, the pair of side rails are rigidly attached to the center support rail. In various embodiments, the support and stock are integrally molded together.

Accordingly, one aspect of the disclosure is to provide an improved firearm including a barreled action; a stock; and a center rail support located between the barreled action and the stock.

Another aspect of the disclosure is to provide for in an improved firearm having a barreled action and a stock for receiving the barreled action: the improvement including a support located between the barreled action and the stock, the support including a center support rail and a pair of side rails located parallel to the center support rail.

Still another aspect of this disclosure is to provide an improved firearm including a barreled action; a stock; a support located between the barreled action and the stock, the support including a center support rail and a pair of side rails located parallel to the center support rail; and a harmonic tuner assembly for the barrel.

These and other aspects of the present invention will become apparent to those skilled in the art after a reading of the following description of the preferred embodiment when considered with the drawings.

DETAILED DESCRIPTION OF THE FIGURES

Figure 1:
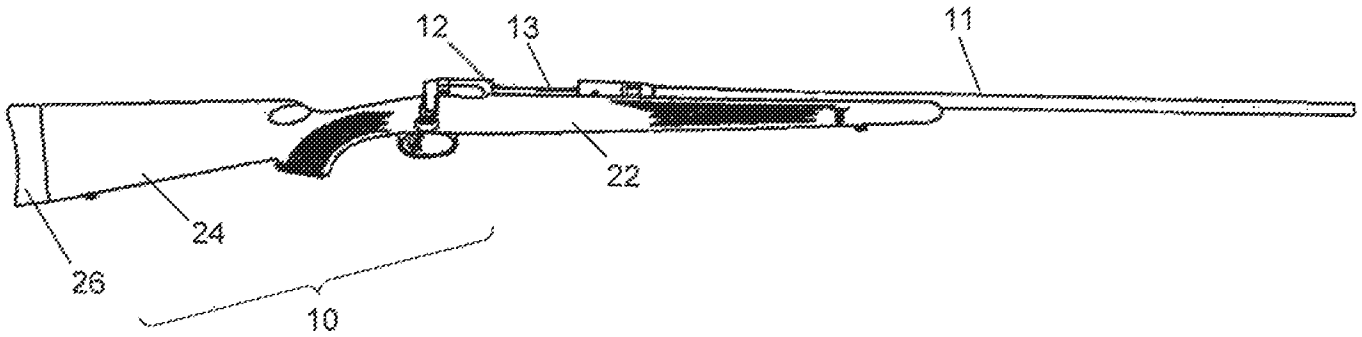
FIG. 1 is a side view of a firearm constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

As best seen in FIG. 1, there is shown a side view of a firearm, generally designated as 10, constructed according to the present inventions. The firearm includes a shoulder 26 for resting the firearm against the operator's body. The firearm also includes a handle 24 where the operator is able to grasp the firearm with one hand or rest the firearm against the forearm. The firearm also includes a forestock 22 about midway the length of the firearm. The operator may grasp hold of the forestock 22 while in operation. The firearm also includes a barreled action 12, used for initiating the firing of a projectile and for aiming a projectile. The barreled action 12 is made of two parts, the receiver 13 whereby the ammunition feeding system is located and the barrel 11 where projectiles travel through after firing.

Figure 2:
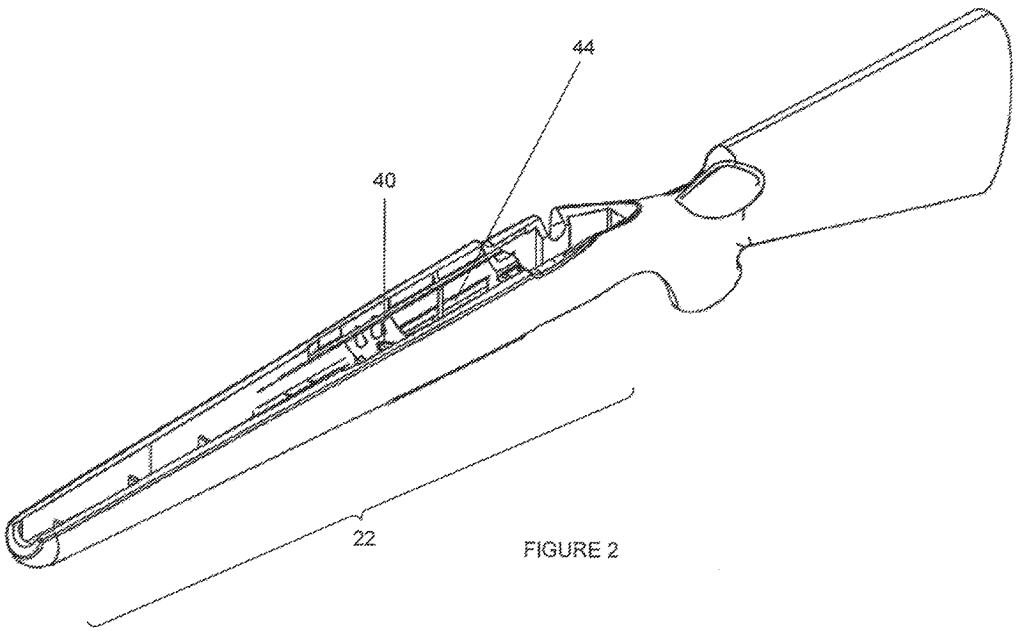
FIG. 2 is a sectional perspective view of the firearm shown in FIG. 1.

FIG. 2 is a perspective view of the improved firearm 10. FIG. 2 shows one aperture 40 for receiving a fastener and an open slot 44 for receiving an ammunition feeding system. In the open slot 44 for receiving an ammunition feeding system, the ammunition feeding system is inserted through the bottom of the firearm and is connected to the barreled action 12. The barreled action 12 rests on the upper portion of the firearm and is secured to the ammunition feeding system, thereby anchoring both items into place. The barreled action 12 may then be further secured by a fastener inserted through aperture 40.

Figure 3:
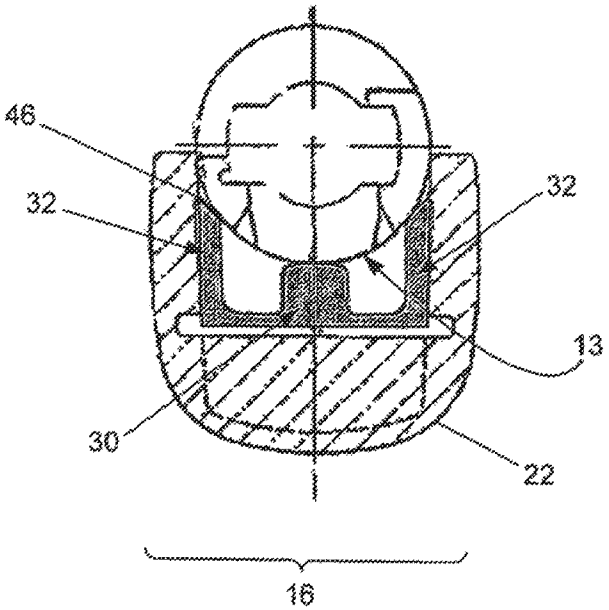
FIG. 3 is a sectional rear view of a center support rail and side rails for the firearm shown in FIG. 1.

FIG. 3 shows a rear sectional view of the support for the improved firearm. The support is generally designated as 16. The support 16 is made of a center support rail 30, which runs about the length of the forestock 22 of the firearm. The center support rail 30 as shown in FIG. 3 also has a pair of side rails 32 attached on both sides. These pair of side rails 32 may run the length of the receiver 13. As shown in FIG. 3 the receiver 13 rests against the side rails and the center support rail thereby forming a 3-point continuous contact along most of the length of receiver 13. To facilitate a continuous contact with the receiver 13 the distal ends 46 of the side rails 32 are sloped inward.

Figure 4:
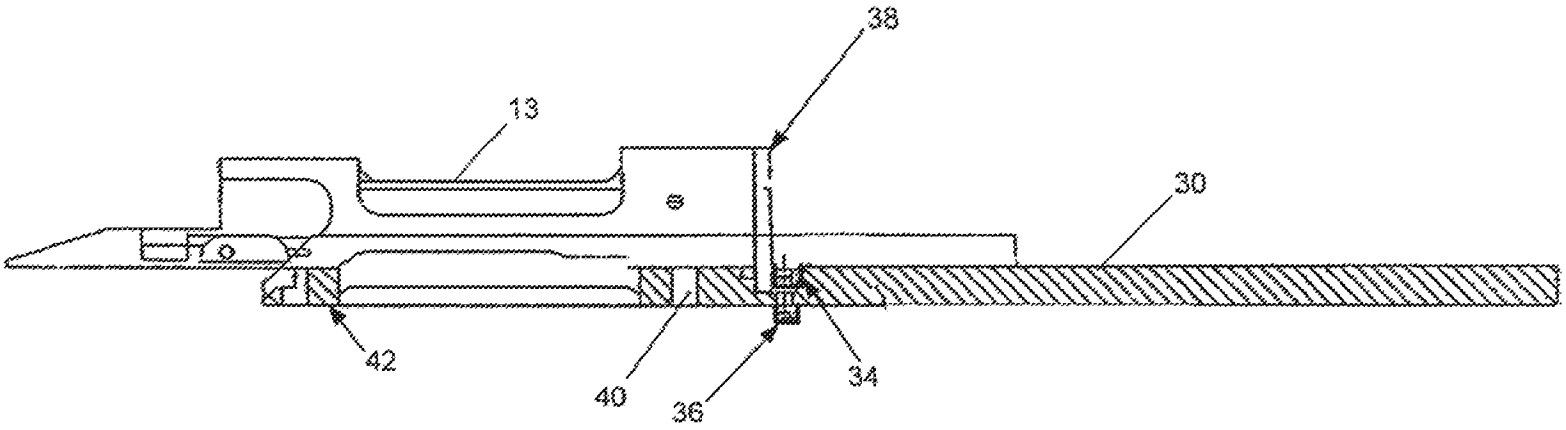
FIG. 4 is a sectional side view of the firearm shown in FIG. 1.

FIG. 4 shows a cross sectional side view of the improved firearm assembly. In FIG. 4, an aperture 42 at the rearward portion of the barreled action attaches a receiver 13 to the center support rail 30. A recoil lug 38 is placed to secure the barreled action and receiver against the center support rail 30 and prevent recoil vibration of the gun. The recoil lug 38 is then secured against a shoulder 34 for receiving the recoil lug by the use of a wedge mechanism 36. Another aperture 40 may be included to secure the receiver 13 to the center support rail 30.

Figure 5:
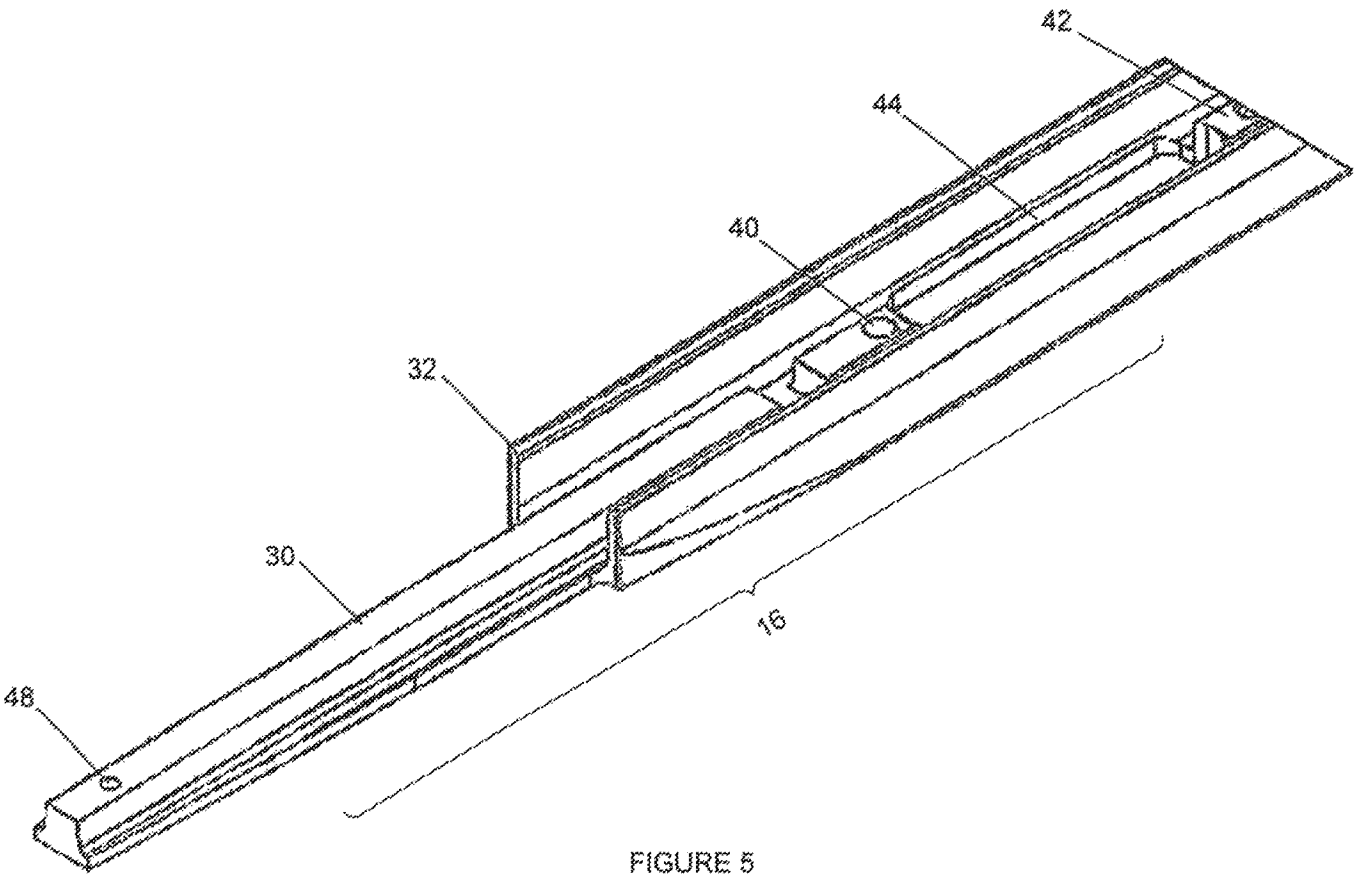
FIG. 5 is a perspective view of the center support rail and side rails show in 30 FIG. 3.

FIG. 5 shows a perspective view of the support 16. The support 16 includes a center support rail 30. The center support rail is attached to a pair of side rails 32. FIG. 5 also shows an aperture 40 for receiving a fastener to secure the receiver to the center support rail. FIG. 5 also shows another aperture 42 also for securing a receiver to the center support rail and an open slot 44 for receiving the ammunition feeding system and may further include at least one aperture 48 for receiving a fastener for attaching at least one recoil lug 38 to the center support rail 30.

Figure 6:
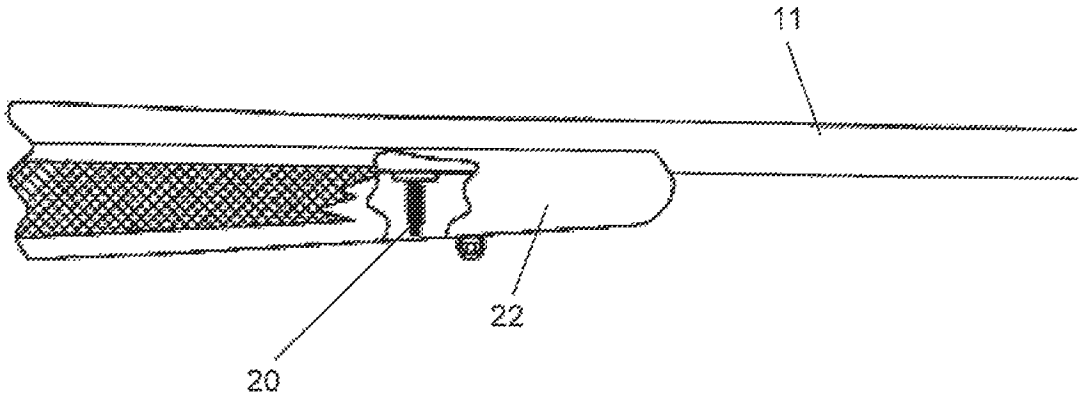
FIG. 6 is a side view of a harmonic tuner assembly constructed according to the present invention.

FIG. 6 shows a side sectional view of a harmonic tuner assembly for the barrel designated as 20. The harmonic tuner 20 is located in the forestock 22 and is secured against the barrel 11.

In operation, the barreled action 12 is secured to the support 16 of the firearm 20 by a series of fasteners and the recoil lug 38. The support 16 is then secured to the forestock 22 with the use of a fastener. Upon assembly of the firearm, the user initiates firing of a projectile through the use of a trigger and firing assembly, which strikes the charged projectile and initiates the powder charge. Upon operation, the user may then adjust the harmonic tuner assembly 20 to reach optimal firing conditions. The harmonic tuner assembly may be adjusted by increasing the force mechanism on the assembly or by moving the assembly along the length of the barrel 11.

Certain modifications and improvements will occur to those skilled in the art upon a reading of the foregoing description. By way of example, a user could utilize only the center support rail or only the side rails instead of those elements working in conjunction with one another. Also, the user could elect to use a non-continuous support that is fragmented and moveable in the forestock if desired. In addition, the user may elect to have side rails that run the entire length of the forestock instead of the length of the receiver. Also, the user may elect to have a stock made of an alternate material, including but not limited to wood, where the rail may be permanently affixed to the stock. It should be understood that all such modifications 5 and improvements have been deleted herein for the sake of conciseness and readability but are properly within the scope of the following claims.

The invention claimed is:

1. A rifle comprising:

a barreled action comprising a receiver with a forward end, a rearward end, a barrel attached to the forward end;

a stock positioned under the barreled action, the stock comprising a shoulder portion connecting to a handle portion connecting to a forestock portion;

an elongate support positioned in the stock below the barreled action, the elongate support comprising a base portion having an upwardly facing surface and three rails extending upwardly from the upwardly facing surface, the three rails comprising two side rails and a central shorter rail disposed between the two side rails;

the elongate support comprising a rearward end portion, a rearward portion extending forward from the rearward end portion, a mid portion extending forward from the rearward portion, and a forward end portion extending forward from the mid portion;

the rearward end portion having the two side rails and the central shorter rail extending upwardly from the base portion;

the rearward portion having the two side rails and no central shorter rail, the rearward portion of the elongate support defining a slot for receiving an ammunition supply system, the slot interrupts the central shorter rail;

the mid portion having the two side rails and the central shorter rail extending upwardly from the base portion;

the forward end portion having the central shorter rail and no side rails;

the central shorter rail having the same maximum height at the rearward end portion, the forward end portion, and the mid portion;

wherein the two side rails have distal ends that are sloped inward for engaging the receiver, the receiver rests against the distal ends of the two side rails and the two side rails and run the length of the receiver thereby forming continuous contact between the receiver and the distal ends of the two side rails;

wherein each of the side rails extend at a right angle and vertically from the base portion;

wherein the central shorter rail of the elongate support has an upward facing surface, the upward facing surface being positioned below the distal ends of the two side rails, the upwardly facing surface engaging the receiver at the rearward end portion and the midportion.

2. The rifle of claim 1 wherein the elongate support is positioned in the forestock portion of the stock and is sandwiched between the forestock portion and the barreled action.

3. The rifle of claim 1 wherein the barreled action is attached to the elongate support by way of a fastener extending through the elongate support into the barreled action.

4. The rifle of claim 3 wherein the fastener does not engage the stock.

5. The rifle of claim 1 wherein the side rails define two flat parallel plate portions.

6. The rifle of claim 1 wherein the stock is comprised of a synthetic injection molded material.

7. The rifle of claim 6 wherein the stock is integrally molded with the elongate support.

8. The rifle of claim 1 wherein the central shorter rail and each of the two side rails define a pair of channels, a bottom of each channel being defined by the upward facing surface of the base portion.

9. The rifle of claim 1 wherein the slot in the lower base portion is a magazine slot.

10. The rifle of claim 1 wherein each of the side rails is continuous from the rearward end portion through the mid portion.

11. A rifle comprising:

a barreled action comprising a receiver with a forward end, a rearward end, a barrel attached to the forward end;

a stock positioned under the barreled action, the stock comprising a shoulder portion connecting to a handle portion connecting to a forestock portion;

an elongate support positioned in the stock below the barreled action, the elongate support having a rearward end portion with two side rails, and a central shorter rail, all extending from a base portion defining a W-shaped cross section, the rearward end portion joined to a rearward portion having the two side rails, no central shorter rail, and an aperture in the lower base portion, the rearward portion joined to a mid portion with the two side rails, and a central shorter rail, all extending from a base portion defining a W-shaped cross section, the mid portion joined to a forward end portion having the central rail and no side rails, wherein the central shorter rail includes a shoulder portion for receiving a recoil lug of the barreled action;

the two side rails being continuous from the rearward end portion through the rearward portion and through the mid portion, wherein the two side rails have distal ends that are sloped inward, the receiver rests against the distal ends of the two side rails and the two side rails and run the length of the receiver thereby forming continuous contact between the receiver and the distal ends of the two side rails.

12. The rifle of claim 11 wherein the central shorter rail and each of the two side rails define a channel therebetween.

13. A rifle comprising:

a barreled action comprising a receiver with a forward end, a rearward end, a barrel attached to the forward end;

a stock positioned under the barreled action, the stock comprising a shoulder portion connecting to a handle portion connecting to a forestock portion;

an elongate support positioned in the stock below the barreled action, the elongate support comprising a base portion having an upwardly facing surface and three rails extending upwardly beyond the upwardly facing surface, the three rails comprising two side rails and a central shorter rail disposed between the two side rails, the two side rails only connecting to the elongate support at the base portion;

the elongate support comprising a rearward end portion, a rearward portion extending forward from the rearward end portion, a mid portion extending forward from the rearward portion, and a forward end portion extending forward from the mid portion;

the rearward end portion having the two side rails and the central shorter rail;

the rearward portion having the two side rails and no central shorter rail, the rearward portion of the elongate support defining an aperture that interrupts the central shorter rail;

the mid portion having the two side rails and the central shorter rail;

the forward end portion having the central shorter rail and no side rails;

the central shorter rail having a constant height through the rearward end portion, the forward end portion, and the mid portion;

wherein the two side rails have distal ends that are sloped inward, the receiver rests against the upward facing surface of the central shorter rail and the distal ends of the two side rails and the two side rails run the length of the receiver thereby forming continuous contact between the receiver and the distal ends of the two side rails;

wherein the central shorter rail includes a shoulder portion for receiving a recoil lug of the barreled action.

14. The rifle of claim 13 wherein the elongate support is positioned in the forestock portion of the stock and is sandwiched between the forestock portion and the barreled action.

15. The rifle of claim 13 wherein the barreled action is attached to the elongate support by way of a fastener extending through the central shorter rail and into the receiver of the barreled action.

16. The rifle of claim 13 wherein the side rails define two flat parallel plate portions.

17. The rifle of claim 13 wherein the stock is comprised of a synthetic injection molded material.

18. The rifle of claim 13 wherein the stock is integrally molded with the elongate support.

19. The rifle of claim 13 wherein the central shorter rail and each of the two side rails define a pair of channels therebetween, a bottom of each channel being defined by the upward facing surface of the base portion.

* * * * *